US006821569B2

(12) United States Patent
Okada et al.

(10) Patent No.: US 6,821,569 B2
(45) Date of Patent: Nov. 23, 2004

(54) REPAIR COATING METHOD

(75) Inventors: Toshikazu Okada, Kanagawa-ken (JP); Takashi Wakimoto, Kanagawa-ken (JP); Takao Matoba, Kanagawa-ken (JP); Tsutomu Nagasao, Kanagawa-ken (JP)

(73) Assignee: Kansai Paint Co., Ltd., Hyogo-ken (JP)

( * ) Notice: Subject to any disclaimer, the term of this patent is extended or adjusted under 35 U.S.C. 154(b) by 149 days.

(21) Appl. No.: 10/252,877

(22) Filed: Sep. 24, 2002

(65) Prior Publication Data

US 2003/0129300 A1 Jul. 10, 2003

(30) Foreign Application Priority Data

Sep. 25, 2001 (JP) ..... 2001-291798

(51) Int. Cl.[7] ..... B05D 3/02; B05D 3/06
(52) U.S. Cl. ..... 427/492; 427/493; 427/407.1
(58) Field of Search ..... 427/492, 407.1, 427/493

(56) References Cited

U.S. PATENT DOCUMENTS 6,312,765 B1 * 11/2001 Ueno ..... 427/510

FOREIGN PATENT DOCUMENTS

| | | | |
|---|---|---|---|
| CA | 2310715 | * | 6/1999 |
| DE | 19757082 | | 6/1992 |
| EP | 0983801 | | 3/2000 |
| JP | 2001/064578 | * | 2/2001 |
| JP | 2001/334208 | * | 12/2001 |
| WO | WO 99/26728 | | 6/1999 |
| WO | WO 99/26732 | | 6/1999 |

OTHER PUBLICATIONS

European Search Report for applicants corresponding European Patent application, EP 1295649, Mar. 2003.

* cited by examiner

*Primary Examiner*—Erma Cameron
(74) *Attorney, Agent, or Firm*—Fisher, Christen & Sabol

(57) ABSTRACT

A repair coating method which comprises coating a photocurable processing composition (I) onto a damaged area of a substrate to form a processed layer, followed by coating a colored base coating composition (II) onto the processed layer to form a colored base layer, and coating a photocurable clear composition (III) onto the colored base layer to form a clear layer.

9 Claims, No Drawings

REPAIR COATING METHOD

BACKGROUND OF THE INVENTION (1) Field of the Invention

The present invention relates to a repair coating method applicable to an automobile body, a railway vehicle, an industrial equipment, woodworking, etc., and capable of providing good finish in a very short period of time.

(2) Description of the Background Art

The repair coating of the automobile body, etc. is carried out in the art by a coating process which comprises removing an old coating film in a damaged area, applying a putty composition onto the old coating film-removed area, drying, sanding the putty-applied surface, coating thereonto a primer coating composition, sanding, coating a topcoat, and coating a clear coat for finishing.

The repair coating method in the art is such that a cold-setting, two pack type, an unsaturated group-containing polyester resin-based coating composition is used in the putty-applied layer, and a two pack type, acrylic urethane based coating composition is used in the primer layer and clear layer by means of air-drying or force-drying by use of a hot-air, and curing after coating step takes 20 minutes to one hour at 60° C., resulting in producing such problems that repair steps take as a whole a long period of time.

SUMMARY OF THE INVENTION

The present inventors made intensive studies on solving the above problems in the prior art to find out that the use of a one pack type photocurable composition in the substrate processing and the use of a photocurable composition in the clear layer makes it possible to remarkably shorten a total time taken in respective repair steps, and to form a coating film showing good properties in hardness, interlayer adhesion properties, finish properties, and the like, resulting in accomplishing the present invention.

It is an object of the present invention to provide a repair coating method capable of remarkably shortening a total time taken in respective repair steps, and forming a coating film showing excellent coating film performances.

That is, the present invention provides the following repair coating methods (1) to (6).

(1) A repair coating method which comprises coating a photocurable processing composition (I) onto a damaged area of a substrate to form a processed layer, followed by coating a colored base coating composition (II) onto the processed layer to form a colored base layer, and coating a photocurable clear composition (III) onto the colored base layer to form a clear layer.

(2) A repair coating method according to the above method (1), wherein the processed layer formed from the photocurable processing composition (I) is formed from a photocurable putty composition (I-1) containing a polymerizable unsaturated group-containing resin, a polymerizable unsaturated compound and a photopolymerization initiator.

(3) A repair coating method according to the above method (1), wherein the processed layer formed from the photocurable processing composition (I) is a multi-coating film layer comprising a coating film formed from the photocurable putty composition (I-1) and a coating film formed from a photocurable primer composition (I-2).

(4) A repair coating method according to the above method (3), wherein the method comprises coating the photocurable putty composition (I-1) onto the damaged area of the substrate to form a putty layer, coating the photocurable primer composition (I-2) onto the putty layer to form a primer layer, irradiating light to cure both layers simultaneously, coating the colored base coating composition (II) to form a colored base layer, coating the photocurable clear composition (III) to form a clear layer, and irradiating light to cure both layers simultaneously.

(5) A repair coating method according to the above method (3) or (4), wherein the photocurable putty composition (I-1) has a pigment volume concentration in the range of 10 to 30%, and the photocurable primer composition (I-2) has a pigment volume concentration in the range of 10 to 40%.

(6) A repair coating method according to the above method (3), (4) or (5), wherein the photocurable primer composition (I-2) contains (A) an acrylic resin having through an urethane linkage a polymerizable unsaturated group on its side chain, (B) an urethane (meth)acrylate oligomer containing at least one polymerizable unsaturated group in one molecule, and a photopolymerization initiator.

DETAILED DESCRIPTION OF THE INVENTION

Photocurable Processing Composition (I)

The photocurable processing composition (I) in the present invention may contain a polymerizable unsaturated group-containing resin, a polymerizable unsaturated compound and a photopolymerization initiator.

More specifically, the photocurable processing composition (I) may contain a photocurable putty composition (I-1) containing a polymerizable unsaturated group-containing resin, a polymerizable unsaturated compound and a photopolymerization initiator.

The polymerizable unsaturated group-containing resin in the photocurable putty composition (I-1) is a resin having at least one ethylenically unsaturated group in one molecule, and may include, for example, ones prepared by introducing a (meth)acrylate group, allyl group, etc. into a resin such as polyester resin, acrylic resin, vinyl resin, polybutadiene resin, alkyd resin, epoxy resin, urethane resin and the like. These may be used alone or in combination.

The polymerizable unsaturated compound is used as a reactive diluent for the purpose of controlling a viscosity of the coating composition and an unsaturated group concentration in the coating composition, and may include a monomer or oligomer having ethylenically unsaturated group, for example, (meth)acrylate of monohydric or polyhydric alcohol such as ethyl (meth)acrylate, butyl (meth) acrylate, 2-ethylhexyl (meth)acrylate, isobornyl (meth) acrylate, norbornyl (meth)acrylate, adamantyl (meth) acrylate, 2-hydroxyethyl (meth)acrylate, trimethylolpropane tri(meth)acrylate, tetramethylolmethane tetra(meth)acrylate, dipentaerythritol (meth)acrylate, tricyclodecanedimethanol di (meth) acrylate, 2,2-bis (4-(3-methacryloxy-2-hydroxypropoxy)-phenyl)propane, di (methacryloxyethyl) trimethylhexamethylene-diurethane, 2,2-bis(4-methacryloxy-polyethoxyphenyl)propane and the like; ethylene glycol dimaleate, propylene glycol diitaconate, etc.; 4-(meth)acryloyloxyl group-containing aromatic polycarboxylic acid and acid anhydride thereof such as 4-(meth) acryloyloxymethoxycarbonyl phthalic acid, 4-(meth) acryloyloxyethoxy-carbonyl phthalic acid and the like; aromatic vinyl compounds such as styrene, α-methylstyrene, chlorostyrene, vinyltoluene, t-butylstyrene, divinylbenzene and the like; diallyl phthalate, diallyl isophthalate, triallyl phthalate; epoxy acrylate, polyester acrylate, polydimethylsilicone di(meth) acrylate, urethane oligomer, and the like. These may be used alone or in combination.

The photopolymerization initiator may include a photopolymerization initiator which is excited by a light energy on irradiation of light such as ultraviolet rays, visible rays, near infrared rays, and the like to generate a radical so that a radical polymerization may be initiated, for example, an acetophenone based compounds such as 4-phenoxydichloroacetophenone, 4-t-butyldichloroacetophenone, 4-t-butyltrichloroacetophenone, diethoxyacetophenone, 2-hydroxy-2-methyl-1-phenylpropane-1-on, 1-(4-isopropylphenyl)-2-hydroxy-2-methylpropane-1-on, 1-(4-dodecylphenyl)-2-hydroxy-2-methylpropane-1-on, 4-(2-hydroxyphenoxy)-phenyl(2-hydroxy-2-propyl)ketone, 1-hydroxycyclohexylphenylketone, 2-methyl-1-[4-(methylthio)phenyl]-2-morpholinopropanon-1 and the like; thioxanthone based compounds such as thioxanthone, 2-chlorothioxanthone, 2-methylthioxanthone, 2,4-dimethylthioxanthone, isopropylthioxanthone, 2,4-dichlorothioxanthone and the like; benzyl based compounds such as benzyl, benzyldimethylketal, benzyl-β-methoxyethylacetal, 1-hydroxycyclohexylphenylketone and the like; benzophenone based compounds such as benzophenone, methyl o-benzoylbenzoate, Michler's ketone, 4,4'-bisdiethylaminobenzophenone, 4,4'-dichlorobenzophenone and the like; benzoin ether based compounds such as benzoin, benzoin methyl ether, benzoin ethyl ether, benzoin isobutyl ether and the like; camphor quinone, anthraquinone, 3-ketocoumarin, α-naphthyl, diphenylphosphine oxide, acylphosphine oxide, 2,4,6-trimethylbenzoyldiphenylphosphine oxide, bis(2,4,6-trimethylbenzoyl)-phenylphosphine oxide, 10-butyl-2-chloroacrydone, fluolenone and the like.

The photopolymerization initiator may optionally be used in combination with a boron based photosensitizer, oxygen scavenger, chain transfer agent and organic peroxide.

The photocurable processing composition (I) may optionally contain from the standpoints of improvements in adhesion properties to the substrate and topcoating layer, workability, etc. cellulose derivatives such as cellulose acetate butylate, nitrocellulose and the like, non-reactive diluents, thermoplastic resins, phosphate group-containing compounds, fillers and the like.

In the present invention, the processed layer formed from the photocurable processing composition (I) may secondly be a multi-coating film layer comprising a coating film formed from a photocurable putty composition (I-1) and a coating film formed from the photocurable primer composition (I-2).

The photocurable primer composition (I-2) used in the present invention may include any compositions known in the art without particular limitations, specifically may include a composition containing a polymerizable unsaturated group-containing resin, a polymerizable unsaturated compound and a photopolymerization initiator. The polymerizable unsaturated group-containing resin, the polymerizable unsaturated compound and the photopolymerization initiator may include the same ones as described in the photocurable putty composition (I-1) respectively. In the present invention, particularly, the photocurable primer composition (I-2) contains (A) an acrylic resin containing through an urethane linkage a polymerizable unsaturated group on its side chain, (B) an urethane (meth)acrylate oligomer containing at least one polymerizable unsaturated group in one molecule, and a photopolymerization initiator.

The acrylic resin (A) containing through the urethane linkage the polymerizable unsaturated group on its side chain may include ones prepared by introducing a polymerizable unsaturated group into an acrylic resin, for example, according to a method which comprises reacting a hydroxyl group-containing acrylic resin with a compound having an isocyanate group and a polymerizable unsaturated group in one molecule, a method which comprises reacting an isocyanate group-containing acrylic resin with a compound having hydroxyl group and a polymerizable unsaturated group in one molecule, or the like. The polymerizable unsaturated group may include, for example, (meth)acryloyl group, vinyl group, vinyl ether group, allyl group and the like, and may preferably be contained in an amount of 0.2 to 2.0 mol/kg, preferably 0.3 to 1.5 mol/kg based on a solid content of the acrylic resin (A).

The urethane (meth)acrylate oligomer (B) is used for the purpose of improving adhesion properties and water resistance, and may include, for example, one obtained by reacting a compound containing at least two isocyanate groups in one molecule, a hydroxyl group-containing polymerizable unsaturated monomer and a monohydric alcohol.

The hydroxyl group-containing polymerizable unsaturated monomer is used for the purpose of introducing a polymerizable unsaturated group into the urethane (meth) acrylate oligomer (B), and the monohydric alcohol is used for the purpose of blocking an excess amount of isocyanate group in the urethane (meth)acrylate oligomer (B) and controlling a concentration of the unsaturated group. An amount of the polymerizable unsaturated group in the urethane (meth)acrylate oligomer (B) is preferably in the range of 1.0 to 2.5 mol/kg based on a solid content of the component (B).

The photocurable primer composition (I-2) may be used in combination with the polymerizable unsaturated compound as described in the photocurable putty composition (I-1), and may optionally contain an extender pigment, cellulose derivatives, non-reactive diluent, thermoplastic resin, phosphate group-containing compound, filler, resin particles, and the like.

In the present invention, the photocurable primer composition (I-2) may preferably be coated onto a cured putty-applied layer, but, from the standpoint of reducing repair steps, may be coated onto an uncured putty-applied layer to form a coating film layer, followed by irradiating light to cure both layers simultaneously.

In the application of the wet•on•wet coating method, both coating film layers formed from the photocurable putty composition (I-1) and the photocurable primer composition (I-2) respectively are desired to easily transmit light, and particularly are such that the photocurable putty composition (I-1) has a pigment volume concentration (hereinafter may be referred to as PVC) in the range of 10 to 30%, and the photocurable primer composition has a pigment volume concentration in the range of 10 to 40%. The components (I-1) and (I-2) may preferably contain an extender pigment having a high transmission. The extender pigment having the high optical transmission may include, for example, talc, mica, barium sulfate, kaolin, calcium carbonate, clay, silica, quartz, glass and the like. These may be used alone or in combination.

The photopolymerization initiator used in the compositions (I-1) and (I-2) may include a compound excited at a long wave length as in a visible light, near infrared rays and the like for the purpose of curing throughout the interior of a coating film.

Colored Base Coating Composition (II)

In the repair coating method of the present invention, the colored base coating composition may include, without particular limitations, an organic solvent based coating composition, water based coating composition, etc. as usually used in the repair coating, for example, an acrylic lacquer, an urethane-curing type coating composition, a fluorocarbon resin based coating composition, and the like.

The colored base layer may be subjected to air-drying or force-drying by heating to form a cured coating film, but, for the purpose of reducing repair steps, coating of the colored base coating composition (II) may preferably be followed by coating the photocurable clear coating composition (III) onto an uncured colored base layer. In this case, the colored base coating composition (II) may preferably be a composition mainly containing a resin having an active hydrogen group and a color pigment.

The active hydrogen group contained in the above resin may include, for example, hydroxyl group, hydroxyphenyl group, amino group and the like, in the present invention preferably hydroxyl group from the standpoints of good curability and slight coloring, for example, hydroxyl group-containing acrylic resin, hydroxyl group-containing polyester resin, hydroxyl group-containing polyurethane resin, hydroxyl group-containing polyether resin and the like.

The color pigment used in the colored base coating composition (II) may include, for example, a glitter such as aluminum paste, pearl powder, graphite, micaceous iron oxide and the like, titanium white, phthalocyanine blue, carbon black, and the like, and may optionally contain an extender pigment, as well as additives used in the coating composition, for example, a phosphate group-containing acrylic resin, ultraviolet absorbent, photostabilizer, antioxidant, surface controlling agent, pigment dispersant, curing catalyst and the like.

Photocurable Clear Composition (III)

The photocurable clear composition (III) used in the method of the present invention contains a resin containing a polymerizable unsaturated group and an active hydrogen group, a photopolymerization initiator, and optionally a polyisocyanate compound.

The resin containing the polymerizable unsaturated group and the active hydrogen group may preferably include ones containing at least one, preferably about 2 to 50 of the polymerizable unsaturated group per one molecule, and about 2 to about 100 on an average, preferably about 2 to about 50 on an average of the active hydrogen group per one molecule. The polymerizable unsaturated group may include, for example, (meth)acryloyl group, vinyl group, vinyl ether group, allyl group and the like, and the active hydrogen group may include, for example, hydroxyl group, hydroxyphenyl group, amino group and the like.

The resin containing the polymerizable unsaturated group and the active hydrogen group may include, without particular limitations, acrylic resin, polyester resin, polyurethane resin, polyether resin and the like, more specifically may include, for example, a resin prepared by addition of glycidyl (meth)acrylate to an acrylic resin or a polyester resin having hydroxyl group and carboxyl group; a resin prepared by addition of maleic anhydride or itaconic anhydride to a hydroxyl group-having vinyl resin or polyester resin; a resin prepared by addition of (meth)acrylic acid to an acrylic resin having hydroxyl group and epoxy group; a resin prepared by condensation of (meth)acrylic acid with a hydroxyl group-having polyester resin; an unsaturated polyester resin; a resin prepared by addition of 2-hydroxyethyl (meth)acrylate and the like to an isocyanate group-having urethane resin; a resin prepared by addition of an equimolar adduct of 2-hydroxyethyl (meth)acrylate and the like with a diisocyanate compound to a hydroxyl group-having acrylic resin; and the like.

The photopolymerization initiator may include any known ones without particular limitations, specifically may arbitrarily be selected from ones exemplified in the descriptions of the photocurable putty composition (I-1).

The above resin may be used in combination with the same polymerizable unsaturated compound as ones exemplified in the descriptions of the photocurable putty composition (I-1) as the reactive diluent for the purpose of increasing the solid content of the coating composition keeping curability.

The photocurable clear composition (III) used in the method of the present invention may optionally contain cellulose derivatives, non-reactive diluents, thermoplastic resin, anti-blocking agent, organic compounds, ultraviolet light stabilizer, coating film surface controlling agent, antioxidant, flow controlling agent, curing catalyst and the like.

The photocurable clear composition (III) may be coated directly onto a colored base layer, preferably onto an uncured colored base layer, followed by irradiating light, and curing both the colored base layer and a clear layer simultaneously.

In the wet•on•wet coating method as above, a crosslinking agent such as a polyisocyanate compound and the like may preferably be added to either one of the colored base coating composition (II) or the photocurable clear composition (III) as the crosslinking agent component of the composition (II) and the composition (III). For example, addition of the polyisocyanate compound to the photocurable clear composition (III) makes it possible for the polyisocyanate compound contained in the photocurable clear composition (III) to imigrate into the uncured colored base coating film on coating the photocurable clear composition (III) onto the uncured coating film formed from the colored base coating composition (II), resulting in that curing between the active hydrogen in the base coating film and the isocyanate group may proceed, and that adhesion properties of the colored base layer to the clear coating film layer may be improved while the colored base coating film layer being cured.

The polyisocyanate compound may be added to both the colored base coating composition (II) and the photocurable clear composition (III).

Coating

The substrate in the repair coating method of the present invention may include metals such as iron, zinc, aluminum and the like, chemically treated surfaces thereof, plastic, wood, old films coated thereonto, and the like. Preferably, a sanding may be carried out over an area including the damaged area as the substrate of the photocurable processing composition (I) and a surrounding area thereof, followed by coating the photocurable processing composition (I) onto the damaged area. A processing method may arbitrarily be selected depending on the conditions of the damaged area, but may preferably include a method which comprises adding a polymerizable unsaturated compound as in the photocurable putty composition (I-1) to control a coating viscosity, followed by spraying onto the damaged area, and a method which comprises applying the photocurable putty composition (I-1) onto the damaged area to form a putty layer, followed by coating the photocurable primer composition (I-2) onto the putty layer.

A method of applying the putty composition (I-1) onto the damaged area may include the spatula-application method known in the art, and a putty-application method which comprises packing the putty composition (I-1) in a container such as a plastic or metal tube, extruded cartridge and the like, extruding the putty composition (I-1) from the container such as the tube, and directly coating onto the damaged area, optionally followed by smoothing by a roller, a spatula or the like.

In the case where the processed layer formed from the photocurable processing composition (I) in the present invention consists of the putty layer only formed from the photocurable putty composition (I-1), the processed layer may be cured by light irradiation. The light source may include any ones known in the art, without particular limitations, and specifically, for example, halogen lamp, xenone lamp, krypton lamp, metal halide lamp, fluorescent tube, sunlight, semiconductor laser, light-emitting diode, and the like. Irradiation conditions may arbitrarily be selected depending on the thickness and composition of the processed layer.

In the case where the processed layer formed from the photocurable processing composition (I) in the present invention consists of a multi-coating film layer comprising a putty layer formed from the photocurable putty composition (I-1) and the primer layer formed from the photocurable primer composition (I-2), an uncured putty layer formed from the putty composition (I-1) may be subjected to coating of the photocurable primer composition (I-2), but optionally may be subjected to light irradiation for curing. The same light source as above described may be used in the above light irradiation.

Coating of the photocurable primer composition (I-2) may be carried out by the conventional coating method such as a spray coating, roll coater coating, gravure coater coating, screen coating and the like. A spray coating may also be carried out by controlling a coating viscosity.

The coating film formed as above has a dry coating film thickness in the range of 30 to 500 $\mu$m, preferably 50 to 300 $\mu$m.

The primer coating film may be cured by light irradiation, but in the case where the putty layer is uncured, the uncured putty layer and the uncured primer layer may be cured simultaneously. The same light source as above described may be used in the above light irradiation, and irradiation conditions may arbitrarily be selected depending on a thickness and composition of the primer layer or the putty layer. The primer layer formed as above may optionally be subjected to sanding, followed by topcoating.

Coating of the colored base coating composition (II) may be carried out by the conventional coating method such as a spray coating, roll coater coating, gravure coater coating, screen coating and the like. A spray coating may also be carried out by controlling a coating viscosity.

The colored base coating film formed as above may have a dry coating film thickness in the range of 5 to 100 $\mu$m, preferably 5 to 50 $\mu$m. From the standpoints of reducing repair steps and improving adhesion properties, coating of the colored base coating composition (II) may preferably be followed by coating a photocurable clear composition (III) onto a resulting uncured colored base coating film layer, optionally the coating of the colored base coating composition (II) may be followed by drying or force drying by heating prior to the coating of the photocurable clear composition (III).

Coating of the photocurable clear composition (III) may be carried out by the conventional coating method such as a spray coating, roll coater coating, gravure coater coating, screen coating and the like. A spray coating may also be carried out by controlling a coating viscosity.

The clear coating film formed as above may be cured by light irradiation, but in the case where the colored base coating film layer is uncured, the uncured colored base coating film layer and the uncured clear coating film layer may be cured simultaneously. The coating film formed from the photocurable clear composition may have a dry coating film thickness in the range of 10 to 200 $\mu$m, preferably 30 to 100 $\mu$m.

The same light source as above described may be used in the above light irradiation, and irradiation conditions may arbitrarily be selected depending on a thickness and composition of the clear coating film or the colored base coating film.

The present invention provides the following effects.

A combination of the photocurable compositions having quickly curing properties in the repair coating method of the present invention makes it possible to remarkably shorten a total time taken in the whole repair steps. The use of one pack type composition in the substrate processing such as putty coating and primer coating makes it possible to omit times taken in measurements and mixing of the coating composition.

A combination of the wet•on•wet coating between putty coating layer and primer layer, and the wet•on•wet coating between colored base layer and clear layer makes it possible to further shorten times taken in repair steps, and to form a coating film showing excellent properties in curing properties, adhesion properties between layers, and the like.

EXAMPLE

The present invention is explained more in detail by the following Examples and Comparative Examples, in which "part" and "%" represent "part by weight" and "% by weight" respectively.

Preparation Examples of Photocurable Putty Composition

Preparation Examples 1–5

Respective compositions according to the formulations of Composition A as shown in the following Table 1 were mixed and dispersed for 20 minutes in a high speed dissolver, followed by successively adding respective compounds of Composition B as shown in Table 1 to obtain respective putty compositions (PT1) to (PT5).

TABLE 1

| | Preparation Examples | | | | |
|---|---|---|---|---|---|
| | 1 | 2 | 3 | 4 | 5 |
| Putty compositions | PT1 | PT2 | PT3 | PT4 | PT5 |
| Composition A | | | | | |
| SP-1507 (Note 1) | 100 | | 100 | | |
| SP-5003 (Note 2) | | | | 100 | 100 |
| Polyset 1127 (Note 3) | | 100 | | | |
| Polyset 1721 (Note 4) | | | | | |
| styrene | 15 | | 15 | | |
| isobornyl acrylate | | | | 10 | 10 |
| 2-hydroxyethyl acrylate | | 10 | | | |
| cellulose acetate butylate | 5 | 5 | | 5 | |
| titanium white | 10 | 10 | 10 | | |
| talc | 100 | 100 | 100 | 50 | 50 |
| Composition B | | | | | |
| Camphor quinone | 2 | 2 | 2 | 1 | 1 |
| tetra-n-butylammonium n-butyltriphenyl borate (Note 5) | | | 5 | | |
| N,N,2,4,6-pentamethyl aniline (Note 6) | 1 | | | 1 | 1 |

TABLE 1-continued

| | Preparation Examples | | | | |
|---|---|---|---|---|---|
| | 1 | 2 | 3 | 4 | 5 |
| ethyl dimethylaminobenzoate (Note 7) | | 1 | 1 | | |
| PVC/% | 27 | 27 | 27 | 15 | 16 |

(Note 1) SP-1507: Trade name, marketed by Showa Highpolymer Co., Ltd., acrylate group-containing epoxy resin.

TABLE 1-continued

| | Preparation Examples | | | | |
|---|---|---|---|---|---|
| | 1 | 2 | 3 | 4 | 5 |

(Note 2) SP-5003: Trade name, marketed by Showa Highpolymer Co., Ltd., acrylate group-containing epoxy resin.
(Note 3) Polyset 1127: Trade name, marketed by Hitachi Chemical Co., Ltd., allyl group-containing polyester resin.
(Note 4) Polyset 1721: Trade name, marketed by Hitachi Chemical Co., Ltd., allyl group-containing polyester resin.
(Note 5) tetra-n-butylammonium n-butyltriphenyl borate: sensitizer.
(Note 6) N,N,2,4,6-pentamethylaniline: chain transfer agent.
(Note 7) ethyl dimethylaminobenzoate: chain transfer agent.

Preparation Example 6

The putty composition (PT1) obtained in Preparation Example 1 was diluted with styrene so as to be a coating viscosity of 30 seconds (Ford cup #4, 20° C.) to obtain a putty composition (PT6) for spray coating.

Photocurable Primer Composition

Preparation of Acrylic Resin for Photocurable Primer Composition

Preparation Examples 7–10

A reactor equipped with a thermometer, thermostat, stirrer, reflux condenser, dropping pump, and dry air-introducing pipe was charged with 50 parts of xylene, followed by heating up to 115° C. with agitation, dropping a mixture of the monomer and polymerization initiator as shown in Table 2 at a constant speed over 3 hours at 115° C. by use of a dropping pump, keeping at 110° C. for 1.5 hours after the completion of the dropping procedure, dropping a solution prepared by dissolving 0.5 part of azobisisobutylonitrile into 10 parts of xylene over 1.5 hours at a constant speed, keeping at 110° C. for 3 hours with agitation, cooling down to 80° C. while adding 25 parts of xylene for diluting, adding 0.06 part of hydroquinone monomethyl ether as a polymerization inhibitor, 0.06 part of dibutyltindilaurate as an urethane-forming catalyst, unsaturated group-introducing components shown in Table 2, and 14 parts of xylene while introducing a dry air into a liquid phase, keeping at 80° C. for 7 hours to complete an addition reaction so as to obtain an acrylic resin solutions (AP1) to (AP4) for primer compositions.

TABLE 2

| | | | Preparation Examples | | | |
|---|---|---|---|---|---|---|
| | | | 7 | 8 | 9 | 10 |
| Acrylic resin solutions for photocurable primer composition | | | AP1 | AP2 | AP3 | AP4 |
| Formulation | Monomers | styrene | 10.0 | 10.0 | 10.0 | |
| | | methyl methacrylate | 10.0 | 10.0 | 10.0 | 15.0 |
| | | n-butyl methacrylate | 5.0 | 5.0 | 5.0 | 34.5 |
| | | i-butyl methacrylate | 60.0 | 60.0 | 60.0 | 30.0 |
| | | hydroxyethyl methacrylate | 14.0 | 14.0 | 14.0 | 20.5 |
| | | methacrylic acid | 1.0 | 1.0 | 1.0 | |
| | Polymerization initiators | azobisisobutylonitrile | 2.3 | 2.3 | | |
| | | azobis-2-methylbutylonitrile | | | 10.0 | 4.8 |
| | Unsaturated group-introducing components | equimolar adduct of isophorone diisocyanate with hydroxyethyl acrylate | 18.2 | | 18.2 | 27.3 |
| | | isocyanatoethyl methacrylate | | 16.6 | | |
| non-volatile matter (%) | | | 55.0 | 54.5 | 55.5 | 56.8 |
| unsaturated group concentration (mol/kg) | | | 0.5 | 0.9 | 0.5 | 0.6 |

Preparation Examples of Urethane Acrylate Oligomer

Preparation Examples 11–13

A reactor equipped with a thermometer, thermostat, stirrer, reflux condenser, dropping pump and dry air-introducing pipe was charged with isocyanate compounds shown in Table 3, 26 parts of xylene, 0.47 part of hydroquinone monomethyl ether as a polymerization inhibitor, and 0.47 part of dibutyltin dilaurate as an urethane-forming catalyst, followed by heating up to 80° C. while introducing a dry air into a liquid phase with agitation, dropping mixtures of hydroxyl group-containing polymerizable unsaturated monomers and monohydric alcohols at 80° C. over 3 hours at a constant speed by use of a dropping pump, keeping at 80° C. for 5 hours to complete an addition reaction, cooling while adding 216 parts of isopropanol for diluting to obtain urethane (meth)acrylate oligomer solutions (B1) to (B3).

TABLE 3

| | | Preparation Examples | | |
|---|---|---|---|---|
| | | 11 | 12 | 13 |
| Urethane acrylate oligomers | | B1 | B2 | B3 |
| Formulation | | | | |
| isocyanate compounds | N-3300 (Note 8) | 583.5 | 583.5 | |
| | isophorone diisocyanate | | | 222.3 |
| hydroxyl group-containing polymerizable unsaturated monomers | hydroxyethyl acrylate | | 116.1 | |
| | hydroxybutyl acrylate | 288.3 | | 273.9 |

TABLE 3-continued

| | | Preparation Examples | | |
|---|---|---|---|---|
| | | 11 | 12 | 13 |
| monohydric alcohol | ethanol | | 87.5 | |
| | n-butanol | 66.7 | | |
| non-volatile matter (%) | | 80.0 | 77.0 | 68.0 |
| unsaturated group concentration (mol/kg) | | 2.12 | 1.26 | 1.99 |

(Note 8) N-3300: Trade name, marketed by Sumika Bayel Urethane Co., Ltd., solid content 100%, cyclic trimer of hexamethylene diisocyanate, NCO content 21.5%.

Preparation Examples of Photocurable Primer Composition

Preparation Examples 14–18

A reactor was charged with, according to the formulation shown in Table 4 respectively, the acrylic resin solution, urethane acrylate oligomer solution, isobornyl acrylate, pigment and xylene, followed by mixing and stirring, charging glass beads having a diameter of 1.5 mm, dispersing for 20 minutes with a batch sand mill, charging the phosphate monomer and photopolymerization initiator, stirring and adding xylene so that a resulting viscosity may be controlled at 20 seconds (Ford cup #4/20° C.) to obtain primer compositions (PR1) to (PR5).

TABLE 4

| | | Preparation Examples | | | | |
|---|---|---|---|---|---|---|
| | | 14 | 15 | 16 | 17 | 18 |
| Primer compositions | | PR1 | PR2 | PR3 | PR4 | PR5 |
| Acrylic resin solutions | AP1 | 90.9 | | 90.9 | | |
| | AP2 | | 91.7 | | | |
| | AP3 | | | | 144.1 | |
| | AP4 | | | | | 123.2 |
| Urethane acrylate oligomers | B1 | 50 | | | 12.5 | 25 |
| | B2 | | 51.9 | | | |
| | B3 | | | 58.8 | | |
| Isobornyl acrylate | | 10 | 10 | 10 | 10 | 10 |
| Kayamar PM-21 (Note 9) | | 5 | 5 | 5 | 5 | 5 |
| Irgacure 819 (Note 10) | | 4 | 4 | 4 | 4 | 4 |
| Microace L-1 (Note 11) | | 50 | 50 | 50 | 50 | 50 |
| Settling barium sulfate 100 (Note 12) | | 150 | 150 | 150 | 50 | 50 |
| Xylene | | 50 | 50 | 50 | 50 | 50 |
| PVC/% | | 35 | 35 | 35 | 24 | 24 |

(Note 9): Kayamer PM-21, trade name, marketed by Nippon Kayaku Co., Ltd., unsaturated group-containing phosphate monomer.
(Note 10): Irgacure 819, trade name, marketed by Ciba Specialty Chemicals K.K., bis(2,4,6-trimethylbenzoyl)-phenylphosphine oxide.
(Note 11): Microace L-1: talc, marketed by Nippon Talc Co., Ltd., trade name.
(Note 12): Settling barium sulfate 100, trade name, marketed by Sakai Chemical Industry Co., Ltd.

Preparation of Colored Base Coating Composition

Retan PG hybrid full shade No. 835 (trade name, marketed by Kansai Paint Co., Ltd., colored base coating composition containing hydroxyl group-containing acrylic resin as a main resin component) was mixed with PG hybrid thinner 20 (marketed by Kansai Paint Co., Ltd., trade name) so that the viscosity may be controlled at 11 to 12 seconds (Ford cup #4/25° C.) to obtain a one pack colored base coating composition (BT1). On the other hand, Retan PG2K (trade name, marketed by Kansai Paint Co., Ltd.) curing agent was added to Retan PG2K full shade No. 835 (trade name, marketed by Kansai Paint Co., Ltd., base material of acrylic urethane resin based two pack type colored base coating composition) immediately before use in an amount of 20% by weight based on the base, followed by diluting with PG hybrid thinner 20 (trade name as above) so that a resulting viscosity may be 11 to 12 seconds (Ford cup #4/25° C.) to obtain a colored base coating composition (BT2).

Photocurable Clear Composition

Preparation Examples of Acrylic Resin for Photocurable Clear Composition

Preparation Examples 20–21

A reactor equipped with a thermometer, thermostat, stirrer, reflux condenser, dropping pump and dry air-introducing pipe was charged with 50 parts of xylene, followed by heating up to 115° C. with agitation, dropping a mixture of monomers and polymerization initiator as shown in Table 5 at 115° C. over 3 hours at a constant speed by use of a dropping pump, after the completion of dropping, keeping at 110° C. for 1.5 hours, dropping a solution prepared by dissolving 0.5 part of azobisisobutylonitrile into 10 parts of xylene at a constant speed over 1.5 hours, keeping at 110° C. for 3 hours with agitation to complete the polymerization reaction, adding 25 parts of xylene and cooling down to 80° C. while diluting, adding, while introducing a dry air into the liquid phase, 0.06 part of hydroquinone monomethyl ether as a polymerization inhibitor, 0.06 part of dibutyltindilaurate as an urethane-forming catalyst, the equimolar adduct of isophorone diisocyanate with hydroxyethyl acrylate as shown in Table 5 and 14 parts of xylene, and keeping at 80° C. for 7 hours to carry out the addition reaction and to obtain an acrylic resin solutions (AC1) to (AC2) for photocurable clear composition.

TABLE 5

| | | | Preparation Examples | |
|---|---|---|---|---|
| | | | 21 | 22 |
| Acrylic resin solutions for photocurable clear composition | | | AC1 | AC2 |
| Formulation | Monomers | styrene | 10.0 | 10.0 |
| | | methyl methacrylate | 10.0 | 10.0 |
| | | n-butyl methacrylate | 5.0 | 5.0 |
| | | i-butyl methacrylate | 60.0 | 60.0 |
| | | hydroxyethyl methacrylate | 14.0 | 14.0 |
| | | methacrylic acid | 1.0 | 1.0 |
| | polymerization initiator | azobisisobutylonitrile | 2.3 | 2.9 |
| | unsaturated group-introducing components | equimolar adduct of isophorone diisocyanate with hydroxyethyl acrylate | 18.2 | 36.5 |
| non-volatile matter (%) | | | 55.0 | 55.0 |

Preparation Examples of Photocurable Clear Composition

Preparation Examples 23–25

A mixture of respective acrylic resin solutions, urethane acrylate, isobornyl acrylate, photopolymerization initiator and dibutyltindilaurate as the urethane-forming catalyst was stirred with a disper, and polyisocyanate was added just before use according to the composition as shown in Table 6 respectively, followed by adding PG hybrid thinner 20 (trade name, marketed by Kansai Paint Co., Ltd.) so as to control the viscosity at 13 to 14 seconds (Ford cup #4/25° C.) to obtain one pack clear coating compositions (CR1) to (CR3).

TABLE 6

| | | Preparation Examples | | |
|---|---|---|---|---|
| | | 23 | 24 | 25 |
| Photocurable clear compositions | | CR1 | CR2 | CR3 |
| Composition | acrylic resin solution for clear composition (AC1) | 163 | 145 | |
| | acrylic resin solution for clear composition (AC2) | | | 163 |
| | CN983 (Note 13) | 10 | 10 | 10 |
| | isobornyl acrylate | | 10 | |
| | Irgacure-184 (Note 14) | 4 | 4 | 4 |
| | dibutyltindilaurate | 0.05 | 0.05 | |
| | TPA-90EK (Note 15) | 15.6 | 15.6 | |

(Note 13) CN983: marketed by Sartmer Company, trade name, urethane acrylate oligomer.
(Note 14) IRGACURE-184: marketed by Ciba Specialty Chemicals K.K., 1-hydroxycyclohexyl-phenylketone, trade name, photopolymerization initiator.
(Note 15) TPA-90EK: trade name, marketed by Asahi Kasei Corporation, hexamethylene diisocyanate based polyisocyanate.

Coating

Example 1

The putty composition (PT1) obtained in Preparation Example 1 was coated onto a mild steel sheet (90×150×0.8 mm) to be a thickness of 5 mm by use of a spatula, followed by irradiating at an irradiation distance of 15 cm for 10 minutes by use of a halogen lamp, slightly sanding the putty coating surface, spray coating the primer composition (PR1) obtained in Preparation Example 14 to be a dry film thickness of 50 to 100 μm, irradiating at an irradiation distance of 15 cm for 10 minutes by use of the halogen lamp for curing, slightly sanding the primer coating surface with a #600 water-resistant sanding paper, spray coating the colored base coating composition (BT1) obtained in Preparation Example 19 to be a dry film thickness of 15 μm, leaving to stand at room temperature (about 20° C.) for 5 minutes, spray coating the clear composition (CR1) obtained in Preparation Example 23 to be a dry film thickness of 40 μm onto the base coating film surface, and irradiating at an irradiation distance of 50 cm for 10 minutes for curing both coating film layers to obtain a coating test panel.

Examples 2–6

Example 1 was duplicated except that respective compositions shown in Table 7 were used to obtain respective coating test panels.

Example 7

The putty composition (PT6) obtained in Preparation Example 6 was coated onto a mild steel sheet (90×150×0.8 mm) to be a thickness of 300 μm by use of a spray, followed by irradiating at an irradiation distance of 15 cm for 10 minutes by use of a halogen lamp for curing, slightly sanding the putty coating surface with a #600 water-resistant sanding paper, spray coating the colored base coating composition (BT1) obtained in Preparation Example 19 to be a dry film thickness of 15 μm, leaving to stand at room temperature (about 20° C.) for 5 minutes, spray coating the clear composition (CR1) obtained in Preparation Example 23 to be a dry film thickness of 40 μm onto the base coating film layer, irradiating at an irradiation distance of 50 cm for 10 minutes for curing both coating film layers by use of the halogen lamp to obtain a coating test panel.

Example 8

The putty composition (PT4) obtained in Preparation Example 4 was coated onto a mild steel sheet (90×150×0.8 mm) to be a thickness of 5 mm by use of a spatula, followed by spray coating the primer composition (PR4) obtained in Preparation Example 17 to be a dry film thickness of 50 to 100 μm, irradiating at an irradiation distance of 15 cm for 10 minutes by use of a halogen lamp for curing both coating film layers, slightly sanding the primer coating surface with a #600 water-resistant sanding paper, spray coating the colored base coating composition (BT1) to be a dry film thickness of 15 μm, leaving to stand at room temperature (about 20° C.) for 5 minutes, spray coating the clear composition (CR1) obtained in Preparation Example 23 to be a dry film thickness of 40 μm onto the base coating film surface, and irradiating at an irradiation distance of 50 cm for 10 minutes by use of the halogen lamp for curing both coating film layers to obtain a coating test panel.

Example 9

Example 8 was duplicated except the respective compositions shown in Table 7 were used to obtain a coating test panel.

Comparative Examples 1–4

In Comparative Examples 1–4, compositions PT7, PR6 and CR4 were used as shown in Table 7. Coating methods and drying conditions of the above compositions are as follows respectively.

LUC putty cocuring agent (trade name, marketed by Kansai Paint Co., Ltd., organic peroxide based compound) was mixed with LUC Poly Putty (trade name, marketed by Kansai Paint Co., Ltd., base material of unsaturated polyester resin based low temperature-curing two pack putty) in an amount of 2% relative to LUC Poly Putty just before use to obtain a putty composition (PT7), followed by coating the putty composition (PT7) in the same manner as in the putty composition (PT1), and drying at 20° C. so that sanding can be carried out.

JUST Urethane Primer-Surfacer curing agent (trade name, marketed by Kansai Paint Co., Ltd.) was mixed in an amount of 20%, and Retan PG2K Thinner (trade name, marketed by Kansai Paint Co., Ltd.) was mixed in an amount of 20% relative to JUST Urethane Primer-Surfacer (trade name, marketed by Kansai Paint Co., Ltd., base material of acrylic urethane resin based two pack primer-surfacer) with JUST Urethane Primer-Surfacer (as above) respectively to obtain a primer composition (PR6), followed by coating the primer composition (PR6) in the same manner as in the primer composition (PR1), and force-drying at 60° C. so that sanding can be carried out.

A clear composition (CR4) was prepared by mixing PG multi clear HX(Q) (trade name as above, base material of acrylic urethane resin based two pack clear) with PG multi clear HX standard curing agent (trade name as above) in an amount of 50% and PG hybrid thinner 20 (trade name as above) in an amount of 20%, followed by coating in the same manner as in the clear composition (CR1), and drying at 60° C. for 20 minutes.

Except for the above, respective coating test panels were obtained in the same manners as in Examples respectively.

Evaluation Test

Respective coating test panels obtained as above were subjected to evaluation tests as follows. Results are shown in Table 7.

Total drying time: a total time of heating and irradiation time in respective steps.

Initial pencil hardness: Coating of the clear composition was followed by lamp-irradiation or force-drying and leaving to stand at 20° C. for 2 hours. A pencil hardness of the coating layer on the resulting coating test panel was measured in accordance with JIS K-5400 8.4.2 (1990). Evaluation was carried out by breaking.

Finish Properties: Coating of the clear composition was followed by a lamp-irradiation or force-drying and leaving at 20° C. for 24 hours, and visually examining the coating surface of the resulting coating test panel as follows.

⊚: Very good; ○: good; Δ: some distortion on the surface; X: considerable distortion on the surface.

Adhesion properties: Coating of the clear composition was followed by lamp-irradiation or force-drying and leaving to stand at 20° C. for 24 hours, forming cuts reaching the substrate onto the resulting coating test panel by use of a knife to form 100 cut squares at an interval of 2 mm, applying a cellophane tape thereonto, strongly separating the tape to examine a number of remaining squares for evaluating as follows.

○: numbers of remaining squares: 100

X: numbers of remaining squares: 99 or less

Water resistance: Respective coating test panels were dipped into a tap water for 7 days, followed by examining conditions (development of blister) of the coating surface, and carrying out the adhesion properties test as above and a bending test. The bending test was carried out by bending at a central part of the coating test panel by an angle of 90°, and visually evaluating conditions of the bent part.

Conditions of the coating surface: ○: good; Δ: blister partly developed; X: blister wholly developed.

Adhesion properties: ○: Nothing peeled; Δ: partly peeled between the primer layer and the colored base layer; X: wholly peeled between the primer layer and the colored base layer.

Bending test: ○: good; Δ: slightly peeled between substrate and putty layer; X: peeled between substrate and putty layer.

TABLE 7

| | | Examples | | | | | | | | | Comparative Examples | | | |
|---|---|---|---|---|---|---|---|---|---|---|---|---|---|---|
| | | 1 | 2 | 3 | 4 | 5 | 6 | 7 | 8 | 9 | 1 | 2 | 3 | 4 |
| Photocurable processing composition | putty composition | PT1 | PT2 | PT3 | PT4 | PT5 | PT1 | PT6 | PT4 | PT5 | PT7 | PT1 | PT7 | PT1 |
| | primer composition | PR1 | PR2 | PR3 | PR4 | PR5 | PR1 | | PR4 | PR5 | PR1 | PR6 | PR6 | PR1 |
| Colored base coating composition | | BT1 | BT1 | BT1 | BT1 | BT1 | BT2 | BT1 | BT1 | BT1 | BT1 | BT1 | BT1 | BT1 |
| Clear composition | | CR1 | CR1 | CR2 | CR2 | CR1 | CR3 | CR1 | CR1 | CR1 | CR1 | CR1 | CR4 | CR4 |
| Performance Test | | | | | | | | | | | | | | |
| total drying times (min.) | | 35 | 35 | 35 | 35 | 35 | 35 | 25 | 25 | 25 | 50 | 45 | 70 | 45 |
| adhesion properties | | ○ | ○ | ○ | ○ | ○ | ○ | ○ | ○ | ○ | ○ | ○ | ○ | ○ |
| initial pencil hardness | | H | H | H | H | H | H | H | H | H | H | H | HB | HB |
| finish properties | | ○ | ○ | ○ | ○ | ○ | ○ | ○ | ○ | ○ | ○ | Δ | Δ | ○ |
| water resistance | conditions of the coating surface | ○ | ○ | Δ | ○ | ○ | ○ | ○ | ○ | ○ | ○ | ○ | Δ | ○ |
| | adhesion properties | ○ | ○ | ○ | Δ | Δ | ○ | ○ | Δ | Δ | Δ | Δ | Δ | ○ |
| | bending test | ○ | ○ | Δ | Δ | Δ | Δ | ○ | Δ | Δ | Δ | ○ | Δ | ○ |

What is claimed is:

1. A repair coating method which comprises coating a photocurable processing composition (I) onto a damaged area of a substrate to form an uncured processed layer, irradiating light onto the uncured processed layer to form a photocured processed layer, coating a normal temperature or heat-curable colored base coating composition (II) containing a resin having an active hydrogen group to form an uncured colored base layer, coating a photocurable clear composition (III) containing a resin containing a photopolymerizable unsaturated group and an active hydrogen group, a photopolymerization initiator and polyisocyanate compound to form an uncured clear layer, and irradiating light thereonto to cure both uncured colored base layer and uncured clear layer simultaneously.

2. A repair coating method as claimed in claim 1, wherein the photocured processed layer formed from the photocurable processing composition (I) is formed by coating photocurable putty composition (I-1) containing a polymerizable unsaturated group-containing resin, a polymerizable unsaturated compound and a photopolymerization initiator onto the damaged area of the substrate, and irradiating light thereonto.

3. A repair coating method as claimed in claim 1, wherein the photocured processed layer form from the photocurable processing composition (I) is a multi-coating film layer comprising a coating film formed by coating the photocurable putty composition (I-1) onto the damaged area of the substrate followed by irradiating light thereonto and a coating film formed by coating a photocurable primer composition (I-2), followed by irradiating light thereonto.

4. A repair coating method as claimed in claim 3, wherein the method comprises (1) coating the photocurable putty composition (I-1) onto the damaged area of the substrate to form an uncured putty layer, coating the photocurable primer composition (I-2) onto the uncured putty layer to from an uncured primer layer, irradiating light to cure both uncured layers simultaneously to form cured layers, or (2) coating the photocurable putty composition (I-1) onto the damaged area of the substrate to form an uncured putty layer, coating the photocurable primer composition (I-2) onto the cured putty layer to from an uncured primer layer, irradiating light to form a cured primer layer, coating onto the cured layer formed by the coating step (1) or (2) the colored base coating composition (II) containing a resin having an active hydrogen group to form an uncured colored base layer, coating a photocurable clear composition (III) containing a resin containing a photopolymerizable unsaturated group and an active hydrogen group, a photopolymerization initiator and a polyisocyanate compound to form an uncured clear layer, and irradiating light thereonto to cure both the uncured colored base layer and the uncured clear layer simultaneously.

5. A repair coating method as claimed in claim 3, wherein the photocurable putty composition (I-1) has a pigment volume concentration in the range of 10 to 30%, and the photocurable primer composition (I-2) has a pigment volume concentration in the range of 10 to 40%.

6. A repair coating method as claimed in claim 3, wherein the photocurable primer composition (I-2) contains (A) an acrylic resin having through an urethane linkage a polymerizable unsaturated group on its side chain, (B) an urethane (meth)acrylate oligomer containing at least one polymerizable unsaturated group in one molecule, and a photopolymerization initiator.

7. A repair coating method as claimed in claim 4, wherein the photocurable putty composition (I-1) has a pigment volume concentration in the range of 10 to 30%, and the photocurable primer composition (I-2) has a pigment volume concentration in the range of 10 to 40%.

8. A repair coating method as claimed in claim 4, wherein the photocurable primer composition (I-2) contains (A) an acrylic resin having through an urethane linkage a polymerizable unsaturated group on its side chain, (B) an urethane (meth)acrylate oligomer containing at least one polymerizable unsaturated group in one molecule, and a photopolymerization initiator.

9. A repair coating method as claimed in claim 5, wherein the photocurable primer composition (I-2) contains (A) an acrylic resin having through an urethane linkage a polymerizable unsaturated group on its side chain, (B) an urethane (meth)acrylate oligomer containing at least one polymerizable unsaturated group in one molecule, and a photopolymerization initiator.

* * * * *